United States Patent [19]

Martin et al.

[11] Patent Number: 4,934,005

[45] Date of Patent: Jun. 19, 1990

[54] PORTABLE SEATING DEVICE

[76] Inventors: William K. Martin, Audubon 515 W. 165th St., New York, N.Y. 10032; Olivia C. Korringa, P.O. Box #996, Westwood, N.J. 07675

[21] Appl. No.: 246,336

[22] Filed: Sep. 19, 1988

[51] Int. Cl.[5] ..... A47L 10/00

[52] U.S. Cl. ..... 5/431; 5/445

[58] Field of Search ..... 5/431, 432, 443, 445; 128/60, 78, 845, 871, 876; 272/126; 297/466, 468, 482; 2/312; 224/223, 224, 235, 236, 239, 240

[56] References Cited

U.S. PATENT DOCUMENTS

| | | | |
|---|---|---|---|
| 2,280,274 | 4/1942 | Wildermuth | 128/60 X |
| 4,627,109 | 12/1986 | Carabelli et al. | 128/28 X |
| 4,773,106 | 9/1988 | Toso et al. | 5/443 X |
| 4,819,846 | 4/1989 | Hannemann | 2/312 X |

FOREIGN PATENT DOCUMENTS

| | | | |
|---|---|---|---|
| 259006 | 12/1948 | Switzerland | 5/432 |
| 333738 | 8/1930 | United Kingdom | 5/432 |

*Primary Examiner*—Michael F. Trettel

*Attorney, Agent, or Firm*—Iman Abdallah

[57] ABSTRACT

A portable seating device which permits the user to support the back region of the body with the legs of the user when the user is seated with the buttocks on the ground or floor and legs bent at the knees. The device includes a singular strap which fits about the user's body and across the shins of the legs that is selectively adjustable to facilitate adaptation to different body sizes. The device further includes a padded back support cushion which lays against the upper region of the user's back when worn.

9 Claims, 1 Drawing Sheet

PORTABLE SEATING DEVICE

BACKGROUND OF THE INVENTION

The present invention generally relates to portable seating devices. More specifically the present invention relates to seating support means whereby the user's back region is supported by the user's legs when the user is seated with the buttocks on the floor or ground.

Sitting on the ground or floor without back support can cause considerable discomfort in a relatively short period of time. This is particularly true for persons having poor posture or a weak back. The discomfort of sitting without back support can occur under various circumstances, for examples, sitting at outdoor concerts, sitting while hunting or fishing, or sitting while reading or painting.

A body rest is disclosed in British Patent No. 333,738 to Greenwood which comprises a substantially wedge-shaped back member in combination with projecting arm support members to each side of said back member. A pocket is included on one of the arm support members. The weight of the body of a user of this invention is ultimately supported by the bed, divan, motorcar or the like upon which the rest is placed. No provision is made for support of one part of the user's body by another part of the user's body. In U.S. Pat. No. 4,627,109 to Carabelli et. al a lumbosacral support is disclosed which is directed to maintaining the lordotic curve of the spine by putting pressure on the supporting lumbosacral musculature on either side of the spine. This device is operational only in conjunction with separate back support means, such as the back of a chair or seat, and likewise does not provide means to support the back of the user by another part of the user's body. U.S. Pat. No. 4,773,106 to Toso et. al discloses a back support device which includes a padded back support with attached loops which are disposed to wrap around the knees of the seated wearer. The back support device of the Toso invention includes separate means to attach the device to the wearer's body and separate means for engagement of the device with the knees of the wearer. The Toso invention further causes pressure on the wearer's knees by the engagement of the loops thereupon and must be worn with the back support on the lower part of the wearer's back.

SUMMARY OF THE INVENTION

The portable seating device of the present invention comprises a singular elongated strap having a substantially rectangular back support cushion attached at the mid-portion of the inside wall of said strap. The ends of said strap are selectively fastenable to permit the device to be attached to various body sizes. When worn by the user the back support cushion is positioned high on the user's back and the straps extend around the user's body, under the user's arms and across the shins of the user's legs when the user is seated with the buttocks on the ground or floor and the user's legs bent at the knees. An article carrying means is fixedly attached to the elongated strap to one side of said back support cushion.

An object of the present invention is to provide a seating device whereby the back of the user is supported by the legs of the user.

Another object of the present invention is to provide a seating device of simple construction.

A further object of this invention is to provide a portable seating device which is operable without putting pressure on the knees of the user.

A still further object of this invention is to provide a portable seating device which is operable with the back support pad placed on any part of the user's back.

These and other objects and advantages of the present invention will be apparent to those skilled in the art from the following drawings, description of the preferred embodiment, and claims.

PREFERRED EMBODIMENT OF THE INVENTION

Figure 1:
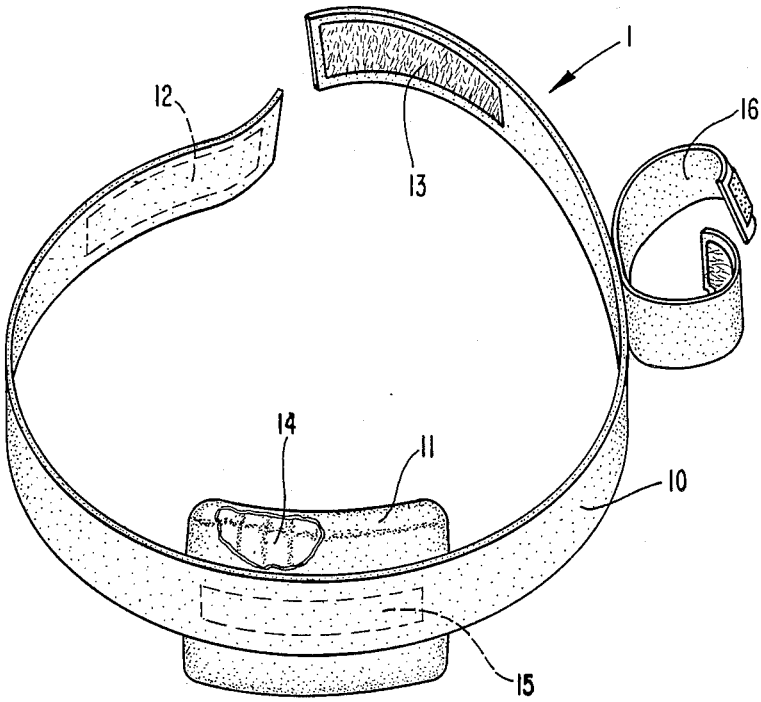
FIG. 1 is a perspective view of the seating device of the present invention.

FIG. 1 illustrates in a perspective view the portable seating device 1 of the present invention. Device 1 comprises a singular strap 10 having a substantially rectangular back support cushion 11 attached at the mid-portion of the inside wall of said strap 10. Strap 10 is preferably formed from a single piece of woven washable fabric doubled and sewn together having a length of six feet, eight inches and a width of three and one-fourth inches wide, said fabric having adequate tensile strength to prevent tearing of the fabric when pulled longitudinally, for example denim, canvas or nylon. Selectively adjustable fastener means are attached to the ends of said strap 10, said fastener means extending for a length of seventeen inches and being two inches wide, said fastener means comprising complementarily engageable portions attached to respective ends of said strap 10, for example hook and loop tape sold under the trademark Velcro, said hook portion 12 being attached to the outer wall at one end of said strap 10 and the loop portion 13 being attached to the inner wall at the opposite end of said strap 10. Back support cushion 11 extends for fourteen inches in length and is six and one-half inches wide and one and one-fourth inches thick and includes foam padding 14 to provide added comfort to the back of the user. The cushion 11 may be fixedly attached to the mid-portion of said strap 10 or removably attachable by means of, for example, Velcro hook and loop tape fastening means 15. Article carrying means 16 is attached to the outer wall of said strap 10 to one side of said cushion 11, said article carrying means 16 comprising a thirteen and one-half-inch by three-fourths-inch strap fastenable by Velcro hook and loop tape. Carrying means 16 is fixedly attached to strap 10. Alternatively, article carrying means 16 may comprise a series of loops formed by sewing a 1" elastic band with vertical stitching at spaced intervals for receipt of ammunition, cartridges and the like.

Figure 2:
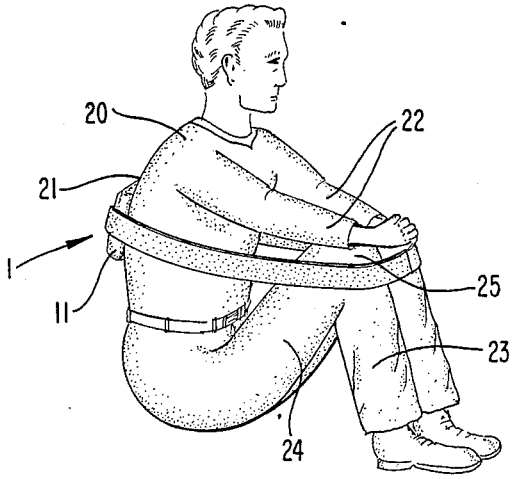
FIG. 2 is a perspective view of a seating device in accordance with the present teachings shown worn by a user seated with buttocks on the ground.

FIG. 2 illustrates how the seating device 1 is worn by a user 20 seated with buttocks on the floor or ground and legs bent at the knees. Seating device 1 is placed around the user's body with the back support cushion 11 positioned on the upper region of the user's back 21. The ends of strap 10 are brought around the sides of the user's body, under the arms 22 of the user, and across the shins 23 of the user's legs 24. This arrangement prevents the development of pressure on the user's knees 25 when tension develops in the strap 10 of the device 1. The complementarily engageable ends of strap 10 are engaged to fasten the device 1 in place. The device 1 may be fastened tautly or loosely as desired by the user.

Therefore in view of the foregoing we claim:

1. A portable seating device providing means to support the back of a user seated crosslegged upon the buttocks with the legs of the user bent at the knees comprising:

a singular elongated strap having complementary engageable fastener means attached at each end of said strap, said fastener means being selectively adjustable, said strap being of a sufficient length to permit said strap to extend across the user's back and around the sides of the user's body under the user's arms and across the shins of the user's legs when the ends of said strap are engaged by said fastener means thereby permitting any tension that develops in the strap to be supported by the legs of the user, a substantially rectangular back support cushion attached at substantially the mid-portion of the inside of said strap, and article carrying means attached to the outside of said strap to one side of said back support cushion.

2. A portable seating device as described in claim 1 wherein said complimentarily engageable fastener means comprises hook and loop tape, said hook portion being attachable to the outer wall at one end of said strap and the loop portion being attachable to the inner wall at the opposite end of said strap.

3. A portable seating device as described in claim 1 wherein said back support cushion is removably attachable to said strap and includes foam padding.

4. A portable seating device as described in claim 1 wherein said article carrying means comprises an adjustably fastenable elongated strap.

5. A portable seating device as described in claim 1 wherein said strap is 6'8" in length.

6. A portable seating device providing means to support the back of a user seated crosslegged upon the buttocks with the legs of the user bent at the knees comprising:

a singular elongated strap having complementarily engageable fastener means attached at each end of said strap, said fastener means being selectively adjustable, said complementarily engageable fastener means comprising hook and loop tape, the hook portion of said tape being fixedly attached to the outside of said strap at one end of said strap and the loop portion of said tape being fixedly attached to the inside of said strap at the opposite end of said strap, said strap being of a sufficient length to permit said strap to extend across the user's back and around the sides of the user's body, under the user's arms and across the shins of the user's legs when the ends of said strap are engaged by said fastener means thereby permitting any tension that develops in the strap to be supported by the legs of the user, a substantially rectangular back support cushion attached at substantially the mid-portion of the inside of said strap, said back support cushion being removably attachable to said strap and including foam padding, and article carrying means attached to the outside of said strap to one side of said back support cushion.

7. A portable seating device as described in claim 6 wherein said article carrying means comprises an adjustably fastenable elongated strap.

8. A portable seating device as described in claim 6 wherein said article carrying means is fixedly attached to said strap and comprises a series of looped openings.

9. A portable seating device as described in claim 6 wherein said strap is 6'8" in length.

* * * * *